US005466173A

United States Patent [19]

Down

[11] Patent Number: 5,466,173

[45] Date of Patent: Nov. 14, 1995

[54] LONGITUDINALLY COMPRESSIBLE COAXIAL CABLE CONNECTOR

[76] Inventor: William J. Down, 8732 W. Weldon Ave., Phoenix, Ariz. 85037

[21] Appl. No.: 123,006

[22] Filed: Sep. 17, 1993

Related U.S. Application Data

[63] Continuation-in-part of PCT/US92/04523, filed May 29, 1992.

[51] Int. Cl.[6] ..... H01R 9/07

[52] U.S. Cl. ..... 439/584; 439/578

[58] Field of Search ..... 439/578–585, 439/675, 877–879, 394

[56] References Cited

U.S. PATENT DOCUMENTS 3,517,375 6/1970 Mancini ..... 439/585

3,963,320 6/1976 Spinner ..... 439/584

4,668,043 5/1987 Saba et al. ..... 439/585

4,990,106 2/1991 Szegda ..... 439/585

*Primary Examiner*—David L. Pirlot

*Attorney, Agent, or Firm*—Parsons & Associates; Don J. Flickinger; Robert A. Parsons

[57] ABSTRACT

A connector for securing the end of a coaxial cable to a selected device in a cable transmission system includes an outer member, a coupling member attached to an end thereof, and a securement element for mechanically and sealably engaging coaxial cable in response to a longitudinal compressive force.

28 Claims, 6 Drawing Sheets

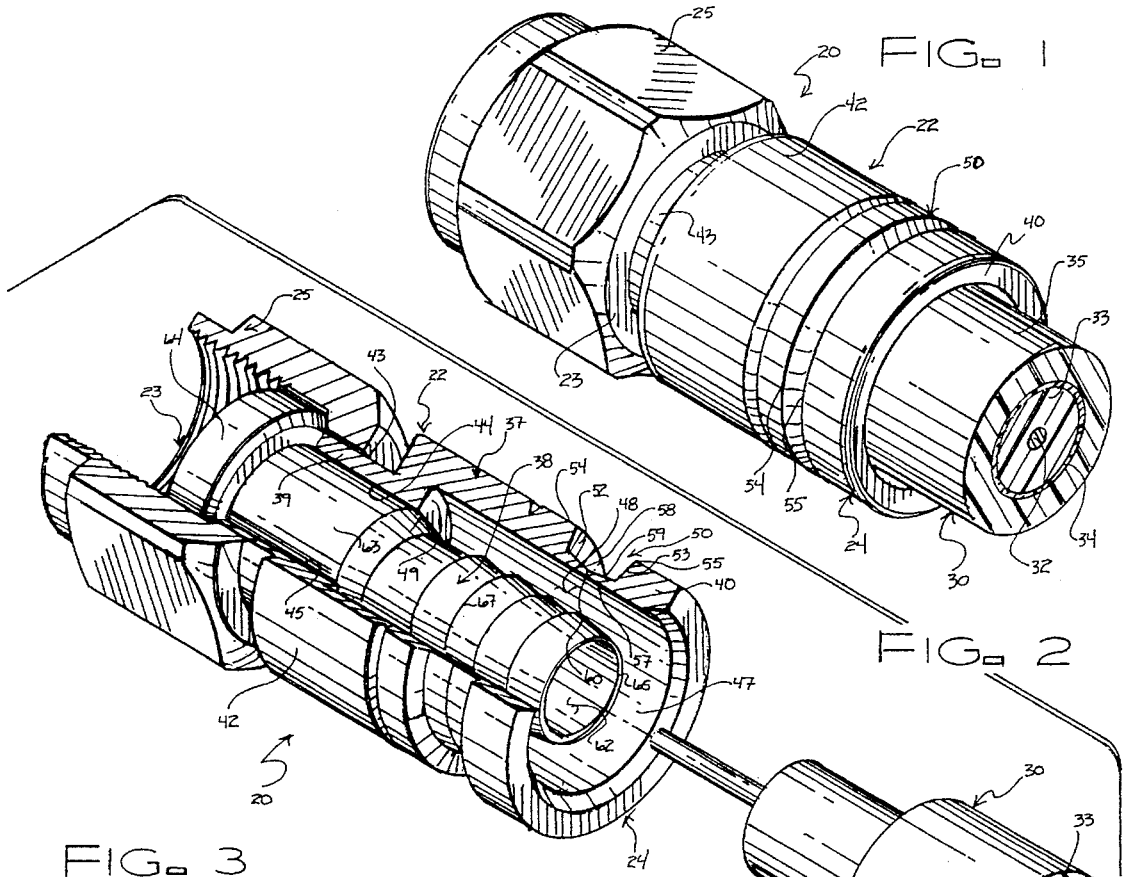
FIG. 1
FIG. 2
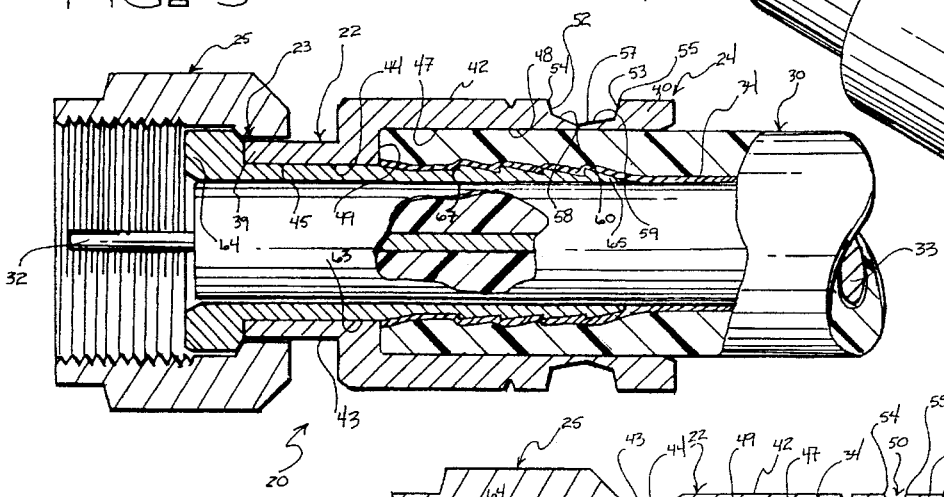
FIG. 3
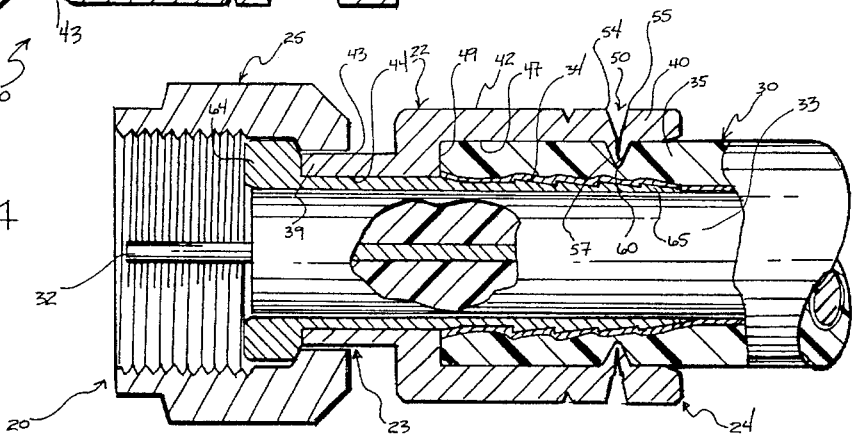
FIG. 4

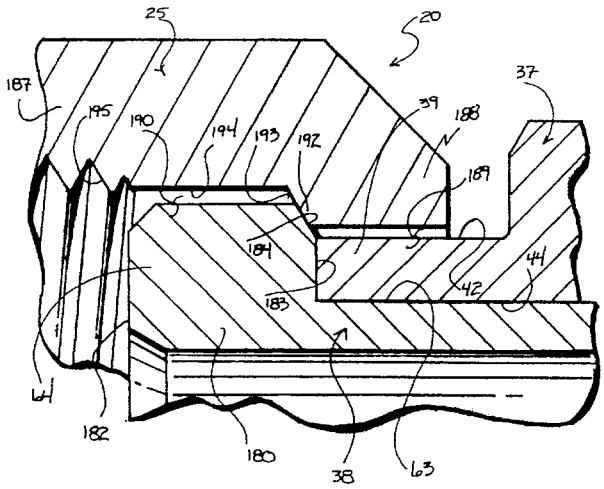
FIG. 9
FIG. 10
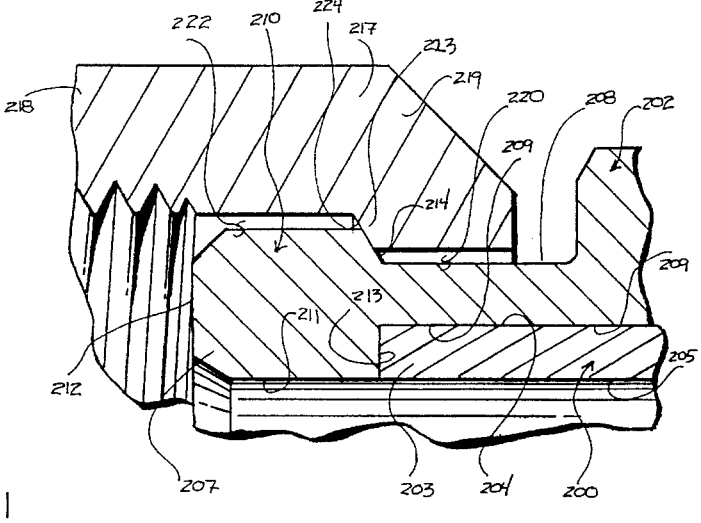
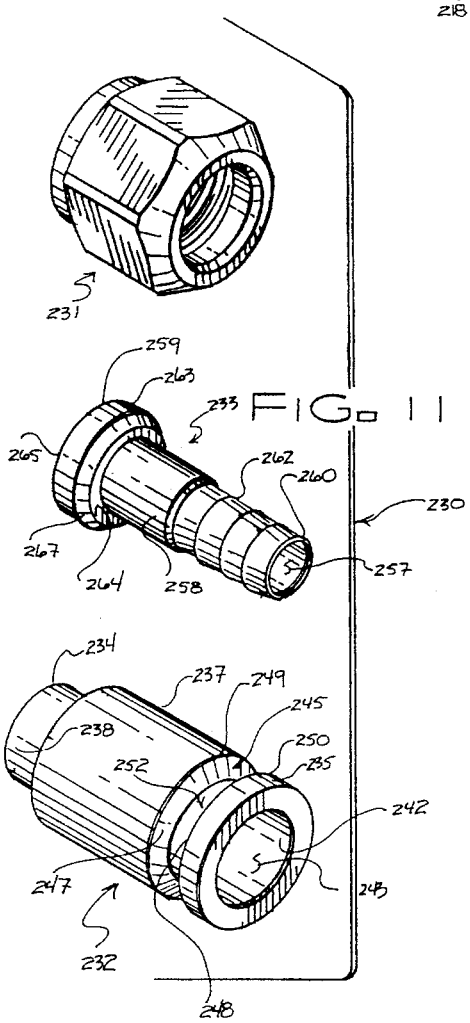
FIG. 11
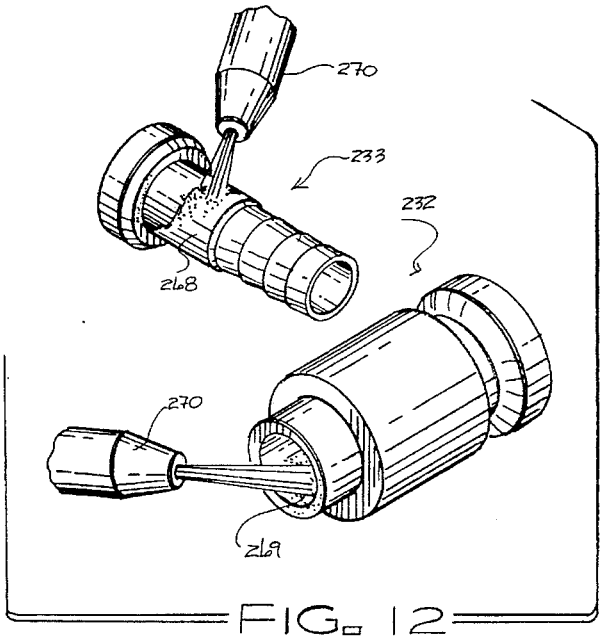
FIG. 12

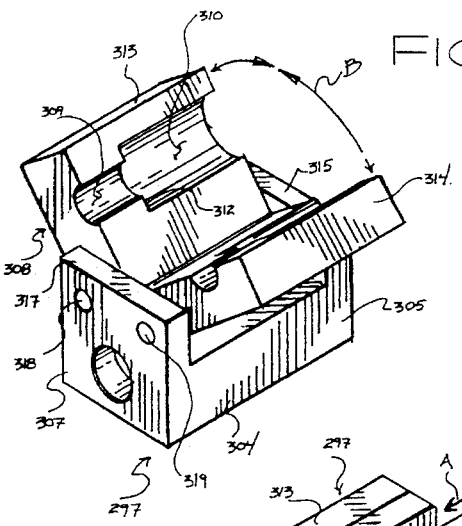
FIG. 18
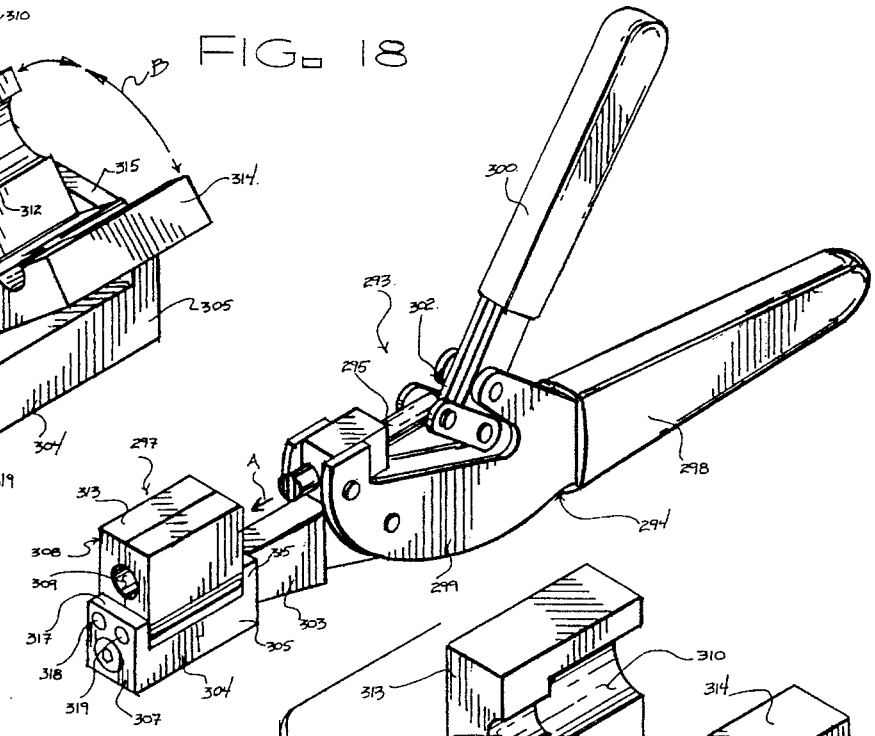
FIG. 16
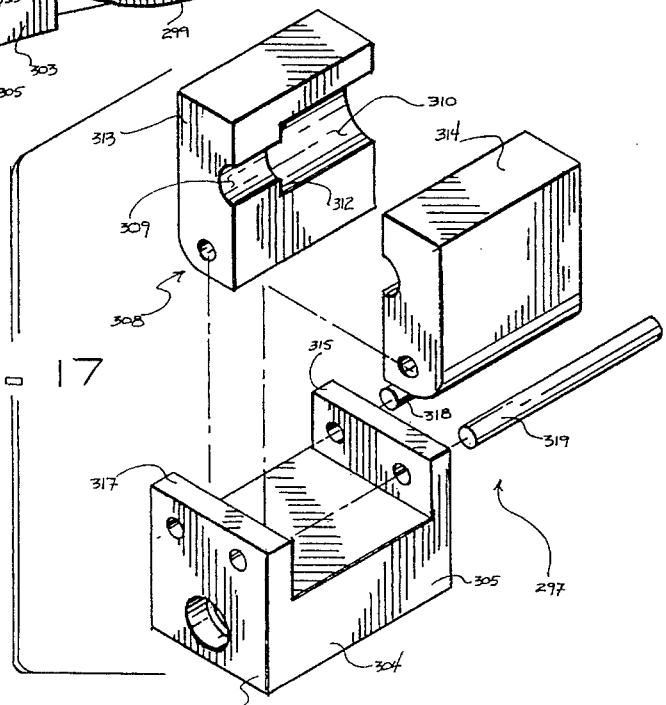
FIG. 17
FIG. 19
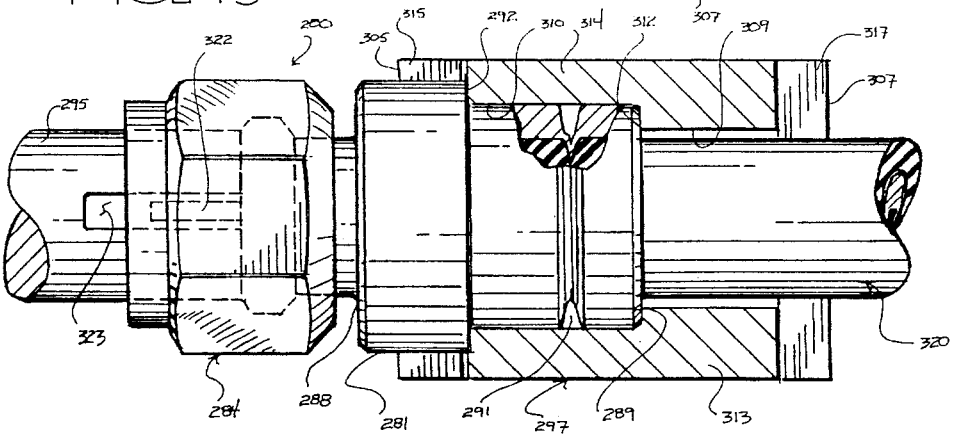

LONGITUDINALLY COMPRESSIBLE COAXIAL CABLE CONNECTOR

This is a Continuation-In-Part of pending PCT Patent Application No. PCT/US92/04523, filed 29 May 1992.

1. Field of the Invention

This invention relates to cable transmission systems.

More particularly, the present invention relates to connectors of the type normally used to connect coaxial cable to devices within a cable transmission system.

In a further and more specific aspect, the instant invention concerns improvements for securing a connector to a coaxial cable.

2. Prior Art

Cable transmission systems for the transfer of signals between devices are well-known. Exemplary systems are cable antennae television (CATV) and local area networks (LAN). Generally included are remotely located primary devices such as a central computer and terminals in a LAN system, or an antennae and receiver sets in a CATV system. Intermediate the primary devices, the typical system may also include various auxiliary devices, such as couplers, directional taps, and amplifiers.

Coaxial cable provides signal communication among several devices in a system. Commercially available coaxial cable includes a center conductor and an outer conductor separated and insulated by a dielectric and encased in a protective jacket. The conductive elements are commonly fabricated of metal, such as copper or aluminum. Polyethylene and polyvinyl chloride (PVC) are usually materials for the non-conductive components.

Characteristically, the center conductor is a solid wire which is coaxially carried within the cylindrical dielectric. The outer conductor includes two elements, a foil sheath encasing the dielectric and a pliant wire braid woven above the foil sheath. The tubular protective jacket snugly embraces the wire braid. Numerous connectors are used throughout a typical cable transmission system. A connector, for example, is interposed between each of the several devices and the respective cable. One end of a connector is mechanically and electrically securable to the cable end, while the other end is especially adapted for attachment to the device.

Conventional means for securing the cable includes a pair of coaxial tubular member extending from the body of the connector. The outer tubular member is a relatively thin-walled structure of uniform thickness defined by inside and outside surfaces which are sections of concentric right cylinders. The inner tubular member is similarly structured. Gripping means, such as annular ridges, are usually formed on the outside surface of the inner tubular member. Gripping means on the inside surface of the outer tubular member is also known.

During assembly, the end of the cable is inserted into the outer tubular member while simultaneously the inner tubular member is forced between the dielectric and the outer conductor. Subsequently, the outer tubular member is compressed, captivating the jacket and the outer conductor between the tubular members and embedding the gripping means into the adjacent portion of the cable. Generally, a hexagonal crimping tool is utilized to apply a compression force to the outer tubular member, deforming in to a predetermined configuration and measurement.

There are several inherent problems using a connector of this sort. First, the hexagonal crimping tool does not apply a uniform compression force on the outer tubular member. Rather, the hexagonal crimp leaves several uncompressed or partially compressed zones between the outer tubular member and the jacket of the coaxial cable. These zones are possible avenues of moisture infiltration, and are weak areas in the connection. Infiltrated moisture may eventually contact the braided shield and degrade the signal transmission performance of the connector.

To partially overcome these problems associated with hexagonal crimping, a prior art connector has been developed which includes a connector body having an annular collar member which peripherally engages the jacket of a coaxial cable, a post member coaxially disposed within the annular collar member to engage the dielectric insulation and the braided shield of the coaxial cable, and a rotatable nut member disposed in combination with the collar and post member. A compression sleeve is configured for snap fitting engagement between the jacket of the coaxial cable and the annular collar member.

The coaxial cable is inserted through the sleeve, and into the connector body. The sleeve, which is a separate piece, is then snapped into the connector body. While this forms a moisture seal between the coaxial cable and the connector, this solution requires the installation of an additional element with the associated cost and time considerations as well as the potential for loss of one of the elements. Furthermore, while the sleeve is securely snapped into engagement with the connector body, the coaxial cable has not been crimped in place, but has only been compressed between the sleeve and the post member during insertion of the sleeve.

Coaxial cable is commercially available in various nominal sizes or series, each embracing several specific outside diameters. To insure proper securement between the cable and the connector, usually forty pounds minimum tensile strength, the prior art has resorted to an elaborate scheme. The scheme requires that each connector be available with numerous outer tubular members in an assortment of specific sizes to closely receive a respective cable of particular diameter. Since each tubular member must be compressed in accordance with predetermined standards, it is necessary that crimp tools be equally as numerous.

The elaborate prior art schemes have placed an undo burden upon all concerned. Each of the myriad of commonly recognizable connectors must be manufactured with numerous alternate outer tubular members. The manufacturer must also provide a crimp tool for each outer tubular member. Correspondingly, suppliers and installers are encumbered with ponderous inventory. Ultimately, the resulting financial burden is borne by the consumer.

SUMMARY OF THE INVENTION

It would be highly advantageous, therefore, to remedy the foregoing and other deficiencies inherent in the prior art.

Accordingly, it is an object of the present invention to provide improvements in connectors of the type especially adapted for use in cable transmission systems.

Another object of the present invention is the provision of improved means for securing a connector to a coaxial cable.

And another object of the present invention is to provide a connector which grips the coaxial cable around its entire circumference.

Yet another object of the present invention is to provide a securement means that can accommodate more than one specific size of cable.

Still another object of the present invention is to provide a securement means which employs a very high contact pressure in the sealing area.

Yet still a further object of the present invention is to provide a connector with sealing means in a one piece construction.

And a further object of the instant invention is to provide a moisture seal without the use of O-rings.

Still a further object of the present invention is to provide a securement means that can be affixed to more than one size of cable with a single crimp tool.

Yet a further object of the present invention is to provide improvements which may assume alternate forms at the option of the manufacturer.

And yet a further object of the present invention is to provide a connector with sealing means having an all metal construction.

Briefly, to achieve the desired objects of the instant invention in accordance with a preferred embodiment thereof, provided is a connector including an outer tubular member having an axial bore for receiving a coaxial cable, a rearward end, and a forward end. A coupling member is attached to the forward end of the outer tubular member for coupling the coaxial cable to a wide variety of various devices and including splicing coaxial cables. Securement means is carried by the outer tubular member for providing mechanical, and sealing engagement with the coaxial cable, in response to a longitudinal compressive force.

BRIEF DESCRIPTION OF THE DRAWINGS

The foregoing and further and more specific objects and advantages of the instant invention will become readily apparent to those skilled in the art from the following detailed description of the preferred embodiment thereof taken in conjunction with the drawings in which:

FIG. 1 is a perspective view of a coaxial connector as it would appear coupled to a coaxial cable;

FIG. 2 is a cut-away perspective view of the coaxial cable and coaxial cable connector illustrated in FIG. 1;

FIG. 3 is a cross-sectional side view of the coaxial cable connector illustrated in FIG. 1, with an unsecured coaxial cable inserted therein;

FIG. 4 is a cross-sectional side view similar to FIG. 3, with the coaxial cable held securely in place by the securement means;

FIG. 9 is an enlarged sectional side view of the interaction between the coupling means and the body of FIG. 1, and further illustrating the coupling of an inner member and an outer member;

FIG. 10 is an enlarged sectional side view of the interaction between a coupling means and a body, and further illustrating an alternate coupling between an inner member and an outer member;

FIG. 11 is a perspective view of the unassembled elements of a further embodiment of a cable connector;

FIG. 12 is a perspective view illustrating elements of the body of the cable connector of FIG. 11 being treated prior to assembly;

FIG. 16 is a perspective view of a crimping tool constructed in accordance the teachings of the present invention;

FIG. 17 is an exploded view of an anvil portion of the crimping tool of FIG. 16;

FIG. 18 is a perspective view illustrating the operation of the anvil of FIG. 16;

FIG. 19 is a side view of the cable connector of FIG. 11 illustrating the crimp limiting means;

DETAILED DESCRIBED OF THE PREFERRED EMBODIMENT

Figure 5:
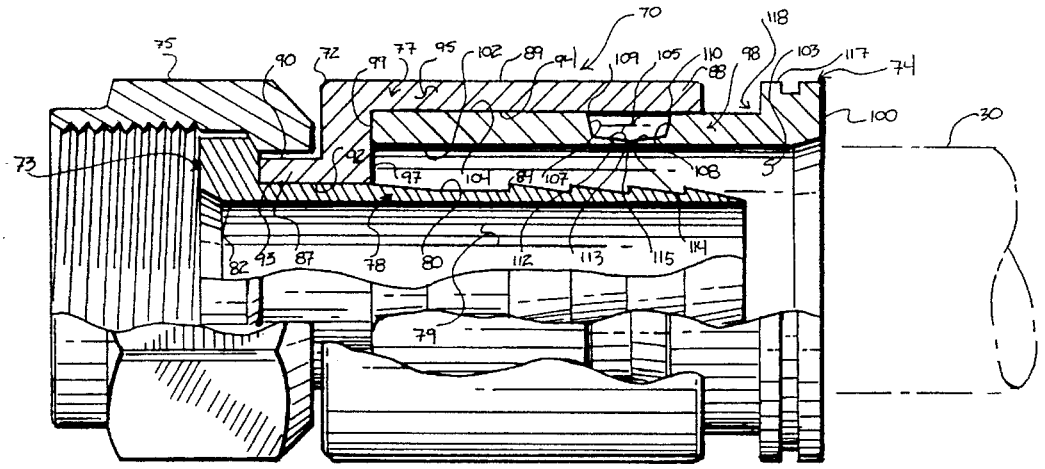
FIG. 5 is a cross-sectional side view of an alternate embodiment of a coaxial cable connector.

Turning now to the drawings in which like reference numerals indicate corresponding elements throughout the several views, attention is first directed to FIGS. 1 and 2 which illustrate a cable connector generally designated by the reference character 20 incorporating improved cable securement means embodying the teachings of the instant invention. In accordance with conventional connectors, connector 20 includes an electrically conductive body 22 usually fabricated of a metal such as brass or aluminum, having a forward end 23 and a rearward end 24. For purposes of orientation and reference and well known by those skilled in the art, forward end 23 of body 22 refers to the end which may be coupled to a selected device, and rearward end 24 of body 22 refers to the end which receives a coaxial cable. Coupling means, being a nut 25 in this embodiment, forms a detachable union with a selected device within a cable transmission system and is rotatably carried by forward end 23 of body 22. It will be appreciated by one skilled in the art that coupling means may be substantially any conventional coupling device for securing a cable connector to a selected device, and is not meant to be limited to nut 25 specifically illustrated.

A conventional coaxial cable generally designated by the reference character 30, including a center conductor 32 encased in a cylindrical dielectric 33 is illustrated in FIG. 2. An outer conductor 34, typically including an inner foil sheath and an outer braid of woven pliant wire encircles dielectric 33. A jacket 35 encircles outer conductor 34 and functions as the outer protective component.

The foregoing description of cable 30 is set forth herein for purposes of orientation and reference in connection with the ensuing detailed description of the improved cable connector of the instant invention. Further and more specific details not described and not illustrated will be readily appreciated by those skilled in the art.

Body 22 includes an elongate outer tubular member 37, an inner tubular member 38 coaxially positioned within outer tubular member 37, and cable securement means. Outer tubular member 37 includes a forward end 39, a rearward end 40, and an outer surface 42 with a terminal surface 43 having a reduced diameter proximate forward end 39. Outer tubular member 37 further includes a reduced inner surface 44 defining an axially bore 45 extending from forward end 39, an expanded inner surface 47 defining a counter bore 48 extending from rearward end 40, and a shoulder 49 formed between bore 45 and counter bore 48.

In accordance with the immediately preferred embodiment of the instant invention, inner surfaces 44 and 47 are cylindrical and each have a substantially uniform diameter. Outer surface 42 is of a substantially uniform diameter, with a circumferential compression groove 50 formed therein intermediate forward end 39 and rearward end 40. Preferably, compression groove 50 is positioned closer to rearward end 40. Compression groove 50 includes opposing sides 52 and 53, each intersecting outer surface 42 of outer member 37 forming spaced apart intersection 54 and 55 respectively. A bottom 57 of compression groove 50 has inward sloping surfaces 58 and 59 extending between sides 52 and 53. Surfaces 58 and 59 slope inwardly, toward bore 45, to a central joint 60. In this embodiment, compression groove 50 is the securement means for forming a mechanical and sealing engagement with coaxial cable 30.

Inner tubular member 38 includes an axially extending bore 62, an outer surface 63, a forward end 64 and a rearward end 65. Preferably, inner tubular member 38 is provided with gripping means such as annular ridges 67 formed in outer surface 63 proximate rearward end 65. Forward end 64 of inner member 38 and forward end 39 of outer member 37 are coupled as will be discussed below.

The securement of cable connector 20, incorporating the previous described embodiment of the instant invention, with cable 30 requires the preparation of the end of cable 30 in accordance with the teachings of the prior art. Cable connector 20 is then joined with cable 30 during which cable 30 is received within counter bore 48 of outer tubular member 37, inner tubular member 38 is received between dielectric 33 and outer conductor 34 with dielectric 33 and center conductor 32 extending into bore 62 as seen in FIG. 3.

With reference to FIG. 4, cable 30 is held in mechanical and sealing engagement with cable connector 20 in response to the application of a longitudinally directed compression force applied to rearward end 40 of outer tubular member 37. A longitudinal compression force applied to rearward end 40 of outer tubular member 37 urges one of intersections 54 and 55 toward the other, resulting in the inward collapse of bottom 57 along central joint 60. As rearward end 40 is longitudinally compressed toward forward end 39, bottom 57 is deformed substantially uniformly radially inward, substantially reducing the diameter of inner surface 47 at this point. Inwardly projecting bottom 57 mechanically engages jacket 35 around its entire circumference and forms a very effective moisture seal, preventing moisture from entering cable connector 20.

Conventional devices require an outer tubular member of specific dimension for each different diameter of cable within a series. Each is then compressed within a corresponding crimp cavity. In a cable series having a variety of specific diameters, a number of different sized outer tubular members and crimp cavities are necessary. By comparison, the improved securement means of the instant invention in accordance with the foregoing description will accommodate a variety of cable diameters, since the application of a greater longitudinal compression force will result in bottom 57 projecting further into counter bore 48. This will allow cables having relatively small diameters to be accommodated in the same size connector 20 as cables having larger diameters.

Referring now to FIG. 5, an alternate embodiment of a cable connector generally designated 70 is illustrated. Cable connector 70 includes a body 72 having a forward end 73 and a rearward end 74. Coupling means, being a nut 75 in this embodiment, forms a detachable union with a selected device (not shown) within a cable transmission system and is rotatably carried by forward end 73 of body 72. Constructed in accordance with the teachings of the instant invention and in general similarity to previously described body 22, body 72 includes an outer tubular member 77, an inner tubular member 78, and cable securement means.

Inner tubular member 78 is substantially similar to inner tubular member 38, having an axially extending bore 79, an outer surface 80, a forward end 82 and a rearward end 83. As with inner tubular member 38, inner tubular member 78 is preferably provided with gripping means such as annular ridges 84 formed in outer surface 80 proximate rearward end 83.

Outer tubular member 77 is substantially similar to outer tubular member 37, including a forward end 87, a rearward end 88, and an outer surface 89 with a terminal surface 90 having a reduced diameter proximate forward end 87. Outer tubular member 77 further includes a reduced inner surface 92 defining an axially bore 93 extending from forward end 87, an expanded inner surface 94 defining a counter bore 95 extending from rearward end 88, and a shoulder 97 formed between bore 93 and counter bore 95.

Securement means, being a generally cylindrical intermediate member 98, having an inner end 99, an outer end 100, an inner surface 102 defining a bore 103 and an outer surface 104, is carried by outer tubular member 77. Inner surface 102 is generally cylindrical and of a substantially uniform diameter. Outer surface 104 is of a substantially uniform diameter, with a circumferential compression groove 105 formed therein, intermediate inner end 99 and outer end 100. Compression groove 105 is defined by opposing sides 107 and 108, each intersecting outer surface 104 of intermediate member 98, forming spaced apart intersection 109 and 110 respectively. A bottom 112 of compression groove 105 has inward sloping surfaces 113 and 114 extending between sides 107 and 108. Surfaces 113 and 114 each extend from sides 107 and 108 respectively, and slope inward, toward inner surface 102. Surfaces 113 and 114 join at a central joint 115 midway between sides 107 and 108. An annular flange 117 extends radially outward from outer surface 104 proximate outer end 100.

Intermediate member 98 extends from body 72 with outer surface 104 of intermediate member 98 residing against inner surface 94 of outer tubular member 77. In its uncompressed configuration, intermediate member 98 extends past rearward end 88 of outer tubular member 77. A gap 118 is formed between rearward end 88 of outer tubular member 77 and annular flange 117 of intermediate member 98. In this embodiment, intermediate member 98 is press fit into outer tubular member 77, with outer surface 104 of intermediate member 98 flush with inner surface 94 of outer tubular member 77.

Figure 6:
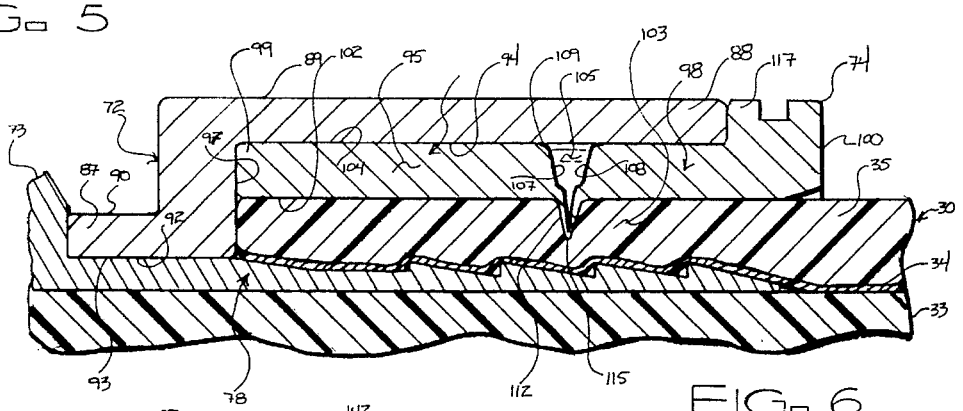
FIG. 6 is a fragmentary cross-sectional side view of the coaxial cable connector illustrated in FIG. 5 with a coaxial cable securely coupled therewith.

The attachment of the immediate embodiment of the instant invention to coaxial cable 30 is analogous to the attachment of the embodiment designated by the reference character 20 with the exception being that intermediate member 98 is longitudinally compressed as illustrated in FIG. 6 instead of outer member 77. Depending upon the diameter of coaxial cable 30, annular flange 117 is moved toward rearward end 88 of outer tubular member 77 reducing gap 118. The compression of intermediate member 98 results in bottom 112 extending substantially uniformly radially inward, deforming inner surface 102 and forcing it against jacket 35.

Figure 7:
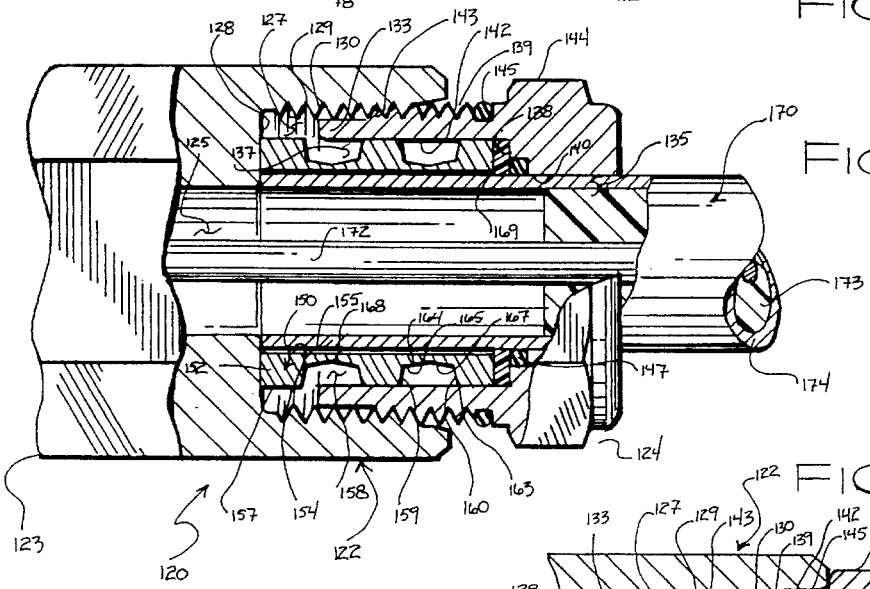
FIG. 7 is a cross-sectional side view of a further embodiment of a coaxial cable connector with an unsecured coaxial cable inserted therein.

Referring now to FIG. 7, a another embodiment of the instant invention generally designated 120 is illustrated. In this embodiment, connector 120 includes a body 122 having a forward end 123, and a rearward end 124. A bore 125 extends through body 122 from forward end 123, and a counter bore 127 extends from rearward end 124 concentric with bore 125, forming a shoulder 128 therebetween. Counter bore 127 is defined by an inner surface 129 having inner threads 130 formed thereon.

A back nut 132 having a forward end 133 and a rearward end 134 is coupled to body 122. A bore 135 extends through back nut 132 from rearward end 134, and a counter bore 137 extends into back nut 132 from forward end 133, concentric with bore 135. Counter bore 137 has a greater diameter than bore 135, forming a shoulder 138 therebetween. Back nut 132 has an outer surface 139, an inner surface 140 defining bore 135 and an inner surface 142 defining counter bore 137. Exterior threads 143 are formed on outer surface 139 proximate inner end 133. A raised portion 144, formed on outer surface 139 proximate outer end 134, acts as a gripping portion for a conventional spanner (not shown). An O-ring 145 is located between exterior threads 143 and raised portion 144 of outer surface 139. Exterior threads 143 of back nut 132 engage interior threads 130 of body 122.

Securement means, in this embodiment, consists of a intermediate member 150 having an inner end 152 in the direction towards body 122, an outer end 153, an inner surface 154 defining a bore 155, and an outer surface 157. Inner surface 154 is generally cylindrical and has a substantially uniform diameter, coplanar with inner surface 140 of bore 135. Outer surface 157 is generally cylindrical, having a substantially uniform diameter, with parallel circumferential compression grooves 158 formed therein. Compression grooves 158 are each defined by sides 159 and 160, which intersect outer surface 157 at spaced apart intersections 162 and 163, and a bottom 164. Bottom 164 includes surfaces 165 and 167 each extending from sides 159 and 160 respectively, and sloping inward toward inner surface 154. Surfaces 165 and 167 join at a central joint 168 midway between sides 159 and 160. A compression washer 169 is positioned between outer end 153 of intermediate member 150 carried within counter bore 137 and shoulder 138 of back nut 132. Intermediate member 150 is carried by counter bore 137 of back nut 132 between shoulder 128 of body 122 and compression washer 169. A second O-ring 147 is positioned between compression washer 169 and shoulder 138, carried within an annular groove formed in shoulder 138.

This embodiment would be used with a coaxial cable 170 having a center conductor 172 encased in a cylindrical dielectric 173. An outer conductor 174, typically of a deformable metallic material, encircles cylindrical dielectric 143. Still referring to FIG. 7, coaxial cable 170 is received in bore 135 of back nut 132, and bore 155 of intermediate member 150, with outer conductor 174 substantially flush with inner surface 140 of bore 135 and inner surface 154 of intermediate member 150. O-ring 147 sealingly engages cable 170 preventing ingress of moisture.

Figure 8:
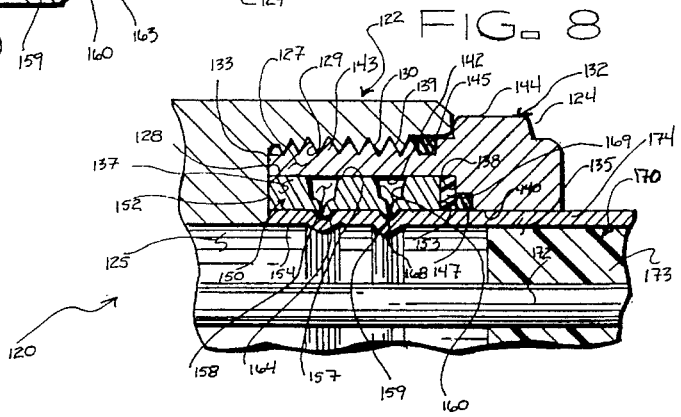
FIG. 8 is a fragmentary cross-sectional side view of the coaxial cable connector illustrated in FIG. 7 with the coaxial cable securely coupled therein by the securement means.

The attachment of coaxial cable 170 to cable connector 120 is illustrated in FIG. 8. Coaxial cable 170 is received by cable connector 120 as illustrated in FIG. 7, and securely held in place by intermediate member 150. Back nut 132 is threadably inserted into body 122, axially compressing intermediate member 150 between shoulder 128 of body 122 and compression washer 169. Intermediate member 150 is compressed, urging intersections 162 and 163 toward one another and deforming bottom 164 in a substantially uniformly radially inward direction against coaxial cable 170. Deformed bottom 164 engages outer conductor 174 around its entire circumference, and results in a mechanical and sealing engagement between cable connector 120 and coaxial cable 170.

As described previously in connection with FIGS. 1–6, the inner members and outer members of the bodies are coupled at their respective forward ends, and carry the coupling member. While there are multifarious means for coupling the inner member to the outer member, the preferred manner of coupling is through the use of an interference fit.

For purposes of reference and orientation, FIG. 9 will be referred to as cable connector 20 of FIGS. 1–4. However, one skilled in the art will appreciate that this may also accurately describe cable connector 70 of FIGS. 4 and 5. An annular collar 180 having a forward abutment surface 182 and a rearward abutment surface 183 extends radially outward from forward end 64 of inner member 38. Rearward abutment surface 183 extends substantially perpendicularly outward from outer surface 63 and receives forward end 39 of outer member 37 thereagainst. A beveled surface 184 is formed in annular collar 180 adjacent to and radially outward from rearward abutment surface 183 and is configured to extend outward past outer surface 42 of outer member 37. Outer member 37 is press fit onto inner member 38 with reduced inner surface 44 adjacent outer surface 63.

Prior to press fitting outer member 37 onto inner member 38, inner member 38 is received within the coupling means, which in this embodiment is a nut 25. Nut 25 has a forward end 187, a rearward end 188, a bore 189 extending therethrough and a counter bore 190 extending therein from rearward end 188 concentric with bore 189. Bore 189 has a smaller diameter than counter bore 190, forming a shoulder 192 therebetween. In this specific embodiment, shoulder 192 has a beveled surface 193 which is configured to engage beveled surface 184 of annular collar 180. Counter bore 190 is defined by an inner surface 194 having inner threads 195 formed thereon. Inner threads 195 of nut 25 engage exterior threads of a selected device (not shown). Beveled surfaces 184 and 193 engage in what is known as a wringing fit in the vernacular of the metal working trade. A ringing fit results when nut 25 is threaded onto the selected device. As the coupling of the selected device is drawn into nut 25, it contacts forward abutment surface 182 of annular collar 180. The interaction between nut 25 and the selected device forces beveled surface 184 against beveled surface 193. In this manner beveled surface 184 is wrought against beveled surface 193 forming a hermetic seal preventing ingress of moisture.

Turning now to FIG. 10, an alternate configuration of the coupling between an inner tubular member 200 and an outer tubular member 202 is illustrated. Outer tubular member 200 and inner tubular member 202 are similar to the previously described inner and outer members with the exception of the inter coupling at the forward ends. It will be understood by those skilled in the art that any of the proceeding embodiments having an inner tubular member and an outer tubular member may be constructed in the following configuration. Inner tubular member 200 includes a forward end 203, an outer surface 204 and an inner surface 205. Outer tubular member 202 includes a forward end 207 an outer surface 208, an inner surface 209, and an annular collar 210 formed at forward end 207. Annular collar 210 extends substantially radially inward from forward end 207 of outer member 202 and includes an inner surface 211. Annular collar 210 also includes a forward abutment surface 212 and a rearward abutment surface 213. Rearward abutment surface 213 extends substantially perpendicularly inward from inner surface 209 and receives forward end 203 of inner member 200 thereagainst such that inner surface 205 of inner member 200 and inner surface 211 of annular collar 210 are substantially congruently coaxial. A beveled surface 214 extends substantially radially outward from outer surface 208 of outer member 202 proximate rearward abutment surface 213. Inner member 200 is press fit into outer member 202 with inner surface 209 adjacent outer surface 204.

Prior to press fitting outer member 202 onto inner member 200, inner member 200 is received within coupling means, which in this embodiment is a nut 217 substantially identical to nut 25. Nut 217 has a forward end 218, a rearward end 219, a bore 220 extending therethrough and a counter bore 222 extending therein from rearward end 219 concentric with bore 220. Bore 220 has a smaller diameter than counter bore 222 forming a shoulder 223 therebetween. In this embodiment, shoulder 223 has a beveled surface 224 which is configured to engage beveled surface 214 of annular collar 210 in a wringing fit identical to that previously described in conjunction with FIG. 9.

Referring now to FIG. 11, a further embodiment of a cable connector generally designated 230 is illustrated. Cable connector 230 includes an outer tubular member 232 having a securement means, an inner tubular member 233, and coupling means which in this embodiment is a nut 231. Each of the preceding elements is generally similar to the elements of cable connector 20 illustrated in FIG. 1 and 9.

Outer tubular member 232 includes a forward end 234, a rearward end 235, and an outer surface 237 with a terminal surface 238 having a reduced diameter proximate forward end 234. Outer tubular member 232 further includes a reduced inner surface 239 (not visible) defining an axial bore 240 (not visible) extending from forward end 234, an expanded inner surface 242 defining a counter bore 243 extending from rearward end 235, and a shoulder 244 (not visible) formed between bore 240 and counter bore 243.

In accordance with the immediately preferred embodiment of the instant invention, inner surfaces 239, 242 are cylindrical and each have a substantially uniform diameter. Outer surface 237 is of a substantially uniform diameter, with a compression groove 245 inscribed therein intermediate forward end 234 and rearward end 235. Preferably, compression groove 245 is positioned closer to rearward end 235. Compression groove 245 includes opposing sides 247 and 248, each intersecting outer surface 237 of outer member 232, forming spaced apart intersections 249 and 250 respectively. A bottom 252 of groove 245 has inward sloping surfaces (not visible) extending between sides 247 and 248. The surfaces slope inwardly toward bore 240 to a central joint (not visible). In this embodiment, compression groove 245 is the securement means for forming a mechanical and sealing engagement with coaxial cable 30 (not shown).

Inner tubular member 233 includes an axially extending bore 257, an outer surface 258, a forward end 259 and a rearward end 260. Preferably, inner tubular member 233 is provided with gripping means such as annular ridges 262 formed in outer surface 258 proximate rearward end 260. An annular collar 263 having a forward abutment surface 264 and a rearward abutment surface 265 extends radially outward from forward end 259 of inner member 233. Rearward abutment surface 265 extends substantially perpendicularly outward from outer surface 258 and receives forward end 234 of outer member 232 thereagainst. A beveled surface 267 is formed in annular collar 263 adjacent to and radially outward from rearward abutment surface 265 and is configured to extend outward past outer surface 237 of outer member 232. Outer member 232 is press fit onto inner member 233 with reduced inner surface 239 adjacent outer surface 258. Forward end 259 of inner member 233 and forward end 234 of outer member 232 are coupled as will be discussed below.

When fitting an inner cylindrical part within an outer cylindrical part various types of fits, such as a clearance fit or an interference fit, may be employed. A clearance fit permits relative freedom of movement between cylindrical parts, while an interference fit provides a certain amount of tightness, securing the parts. Furthermore, an allowance must be made providing clearance between the inner part and the outer part. In a clearance fit the allowance is greater while in an interference the allowance is small or even negative. For both types of fits, nominal dimensions for the inner and outer members must be determined.

With reference to FIG. 9, inner member 38 and outer member 37 are coupled employing an interference fit since relative motion therebetween at their respective forward ends is undesirable. To insure a tight, secure fit, when inner member 38 and outer member 37 are manufactured, a maximum and minimum deviation from the nominal dimension, generally referred to as the manufacturing limits, are determined. The limits determine the tolerance on each part. To press fit inner member 38 within outer member 37, relatively exacting tolerances must be set. If the fit is not tight enough, moisture may enter the coupler through capillary action, and if the members are distorted, an even better leak path is provided. It is generally understood by those skilled in the art that the smaller the tolerances, the higher the cost.

To avoid the need for such exacting tolerances, connector 230 is manufactured with allowances typical of a clearance fit or a loose interference fit. In other words, outer surface 258 of inner tubular member 233 has a diameter which may vary from substantially smaller than the diameter of reduced inner surface 239 of outer member 232, to a loose interference fit. This larger range of tolerances reduces the cost of manufacturing the parts.

Referring now to FIG. 12, in order to couple inner member 233 to outer member 232, outer surface 258 of inner member 233 and reduced inner surface 239 of outer member 232 are treated with a ductile metal such as lead, tin or gold. Thin layers 268 and 269 of ductile metal are deposited onto the inner and outer members 233 and 232 respectively, by spraying through a nozzle 270. Enough metal is deposited to provide an interference fit for the loosest tolerances. Layers 268 and 269 of ductile metal reduce the clearance between the members to a range from a very small clearance, which would normally produce a tight interference fit, to a negative clearance, which in normal situations would require the outer member to expand to accommodate the inner member.

Figure 13A:
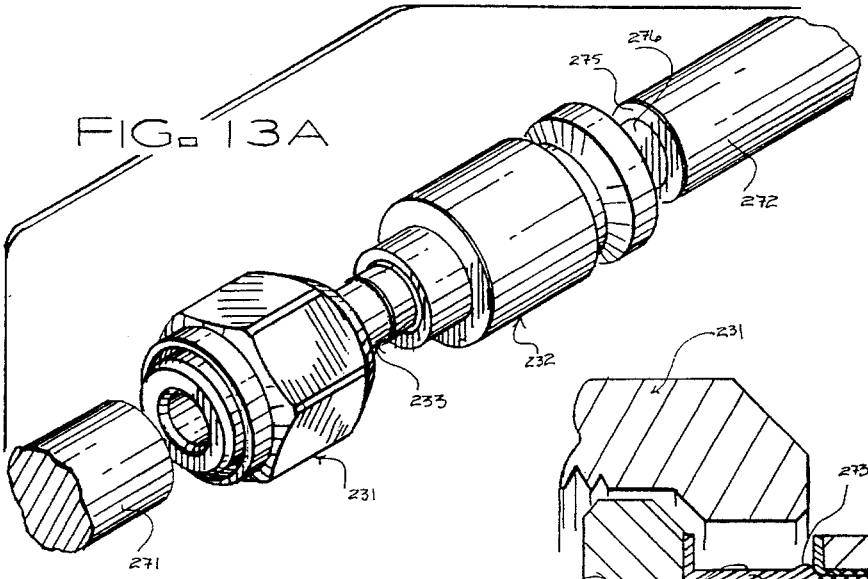
FIG. 13A is a perspective view illustrating the assembly of the cable connector of FIG. 11.
Figure 13B:
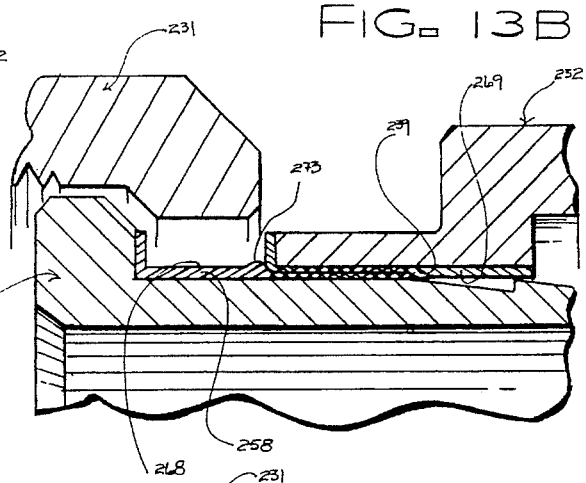
FIG. 13B is an enlarged sectional side view. of the elements of the body illustrated in FIG. 12 being coupled.

Referring now to FIGS. 13A and 13B, inner member 233 is inserted through nut 231 and then pressed into outer member 232. As illustrated in FIG. 13A, a pair of opposing rams 271 and 272 press against inner member 233 and outer member 232 respectively, forcing them together. Ram 272 includes an end 275 and a bore 276 extending axially therethrough. End 275 of ram 272 is received within outer member 232, engaging shoulder 244 (not visible) with bore 276 receiving rearward end 260 of inner member 233. As inner member 233 enters outer member 232, layer 268 on outer surface 258 engages layer 269 on reduced inner surface 239. Forcing inner member 233 into outer member 232 causes a cold flow and bonding of the ductile metal layers as illustrated in FIG. 13B. As inner member 233 is forced into outer member 232, layers 268 and 269 engage, with the extra material cold flowing as shown by swell 273. The larger the outer diameter of inner member 233 with respect to the inner diameter of outer member 232, the more ductile metal is displaced. The amount of metal displaced is determined by the tolerances of the members before treating with the ductile metals. Thus large tolerances may be established reducing costs.

Figure 14A:
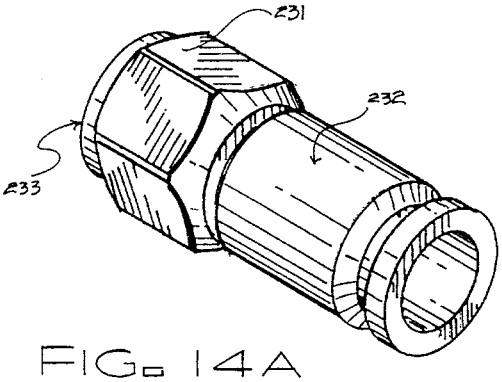
FIG. 14A is a perspective view of the cable connector of FIG. 11 as it would appear assembled.
Figure 14B:
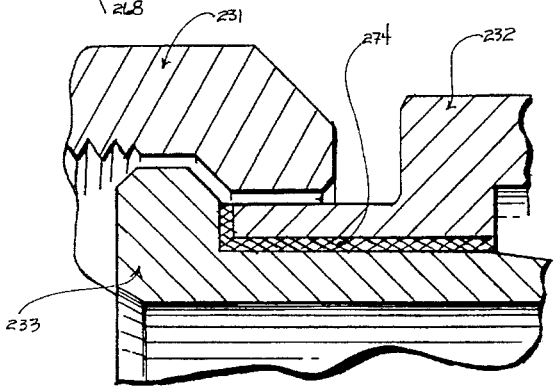
FIG. 14B is an enlarged sectional side view of the cable connector of FIG. 14A.

Referring now to FIGS. 14A and 14B, inner member 233 is shown coupled to outer member 232. As can be seen with specific reference to FIG. 14B, layers 268 and 269 have bonded to form a single coupling layer 274 between inner member 233 and outer member 234. Using this method of fitting inner member 233 into outer member 232 allows for less exacting tolerances, as well as providing a water proof joint between members, insuring good electrical contact, and providing a high corrosion resistance.

Figure 15:
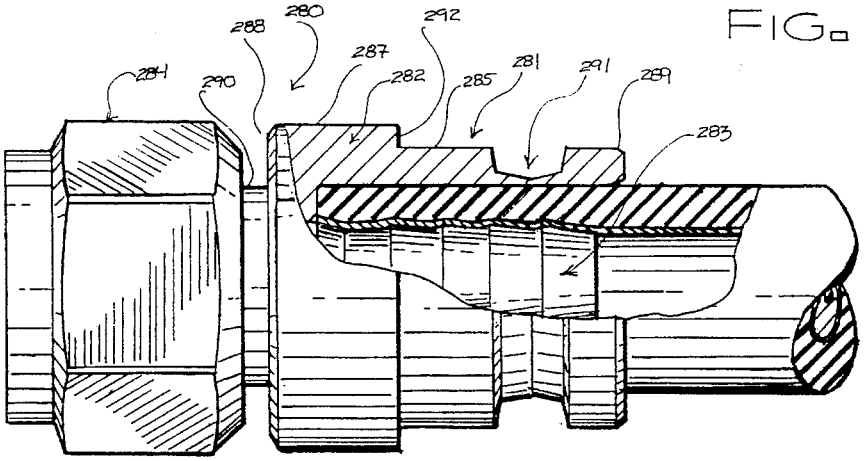
FIG. 15 is a partial sectioned side view of an embodiment of a connector having crimp limiting means as it would appear with a cable unsecured therein.

Referring now to FIG. 15, a further embodiment of a cable connector generally designated 280 is illustrated. Cable connector 280 includes a body 281 and coupling means which, in this embodiment, is a nut 284. Body 281 consists of an outer tubular member 282 having a securement means, and an inner tubular member 283. Each of the preceding elements is generally similar to the elements of cable connector 20 illustrated in FIG. 1 and 9. However, in this embodiment, outer member 282 includes an outer surface 285, having an intermediate portion 287 with an increased diameter intermediate a forward end 288 and a rearward end 289, and a terminal portion 290 with a decreased diameter at forward end 288. A shoulder 292 is formed between outer surface 285 and intermediate portion 287. A compression groove 291, substantially identical to those described previously, is formed in outer surface 285 intermediate shoulder 292 and rearward end 289. Shoulder 292 functions as crimp limiting means in this embodiment, preventing excessive crimping of connector 280 when crimped with a crimping tool 293 illustrated in FIG. 16.

Crimping tool 293, illustrated in FIG. 16, includes a toggle action tool 294 driving a reciprocating ram 295 towards an anvil 297. Toggle action tool 294 consists of a handle 298 terminating in a support structure 299. A lever 300 is pivotally coupled to support structure 299 adjacent handle 298 for operating a toggle mechanism 302 which moves ram 295 between a retracted position and an extended position in a reciprocating motion along a line indicated by arrowed line A. In the extended position, ram 295 extends outward past support structure 299, towards anvil 297. Anvil 297 is attached to support structure 299 by an extension 303 over which ram 295 operates. Anvil 297 includes a base 304, having an inner end 305 and an outer end 307, and a block 308 coupled thereto. Inner end 305 is coupled to extension 303. A bore 309 extends centrally through block 308 from outer end 307, with its axis along line A. A counter bore 310 extends through block 308 from inner end 305, concentric with bore 309 and forming a shoulder 312 therebetween. Block 308 includes opposing halves 313 and 314 pivotally coupled to base 304 in line with ram 295.

With additional reference to FIG. 17, halves 313 and 314 are coupled between brackets 315 and 317 extending from inner end 305 and outer end 307 of base 304. A pin 318 and 319 extends concurrently through halves 313 and 314 and brackets 315 and 317 respectively, pivotally coupling halves 313 and 314 to base 304. With further reference to FIG. 18, halves 313 and 314 pivot outward in relation to base 304 from a closed position to an open position in an opening motion illustrated by arcuate arrowed lines B. In the closed position, halves 313 and 314 reside adjacent one another, forming block 308 with bore 309 and counter bore 310.

Turning now to FIG. 19, the rearward end of connector 280 is placed within counter bore 310 and halves 313 and 314 closed thereabout. A properly prepared cable 320 is inserted through bore 309 from outer end 307 into connector 280 preparatory to crimping. Cable 320 is prepared in a conventional manner well understood by one skilled in the art. Lever 300 is moved toward handle 298, manipulating toggle mechanism 302 and moving ram 295 toward anvil 297. Ram 295 is sized to enter nut 284 of connector 280 and press against the forward end of body 281. To prevent ram 295 from damaging a center conductor 322 extending through connector 280 from prepared cable 320, a notch 323 may be formed in the end of ram 295 allowing pressure to be applied to the forward end without interfering with center conductor 322. Anvil 297 provides even support around the entire periphery of connector 280, ensuring a substantially uniform crimp. A longitudinal compression force applied to forward end 288 of body 281, compresses connector 280 between ram 295 and shoulder 312. As forward end 288 is longitudinally compressed toward rearward end 289, the bottom of compression groove 291 is deformed substantially uniformly radially inward as described in conjunction with previous embodiments. The crimp mechanically engages cable 320 around its entire circumference and forms a very effective moisture seal, preventing moisture from entering cable connector 280.

Crimp depth is generally controlled by the amount of longitudinally compressive force applied, determined by the movement of lever 300. Increasing the stroke length of ram 295 produces deeper crimps. Therefore crimp depth may be controlled by setting specific stroke lengths, or adjusting the length of ram 295. Connector 280 includes a crimp limiting means for preventing over crimping, consisting of shoulder 292 on the outer surface, which engages the inner end of block 308 when the correct amount of crimp has been produced. One skilled in the art will understand that the amount of crimp could be varied by changing the depth of counter bore 310, thereby moving the position of shoulder 312.

Producing the proper crimp depth is important to provide an adequate mechanical and sealing coupling. Over crimping will tend to distort the crimp, providing an inadequate seal and a possible leak path. Crimping can be controlled by crimping tool 293 as discussed above, or by modifications to the connector being crimped as will be described below.

Figure 20:
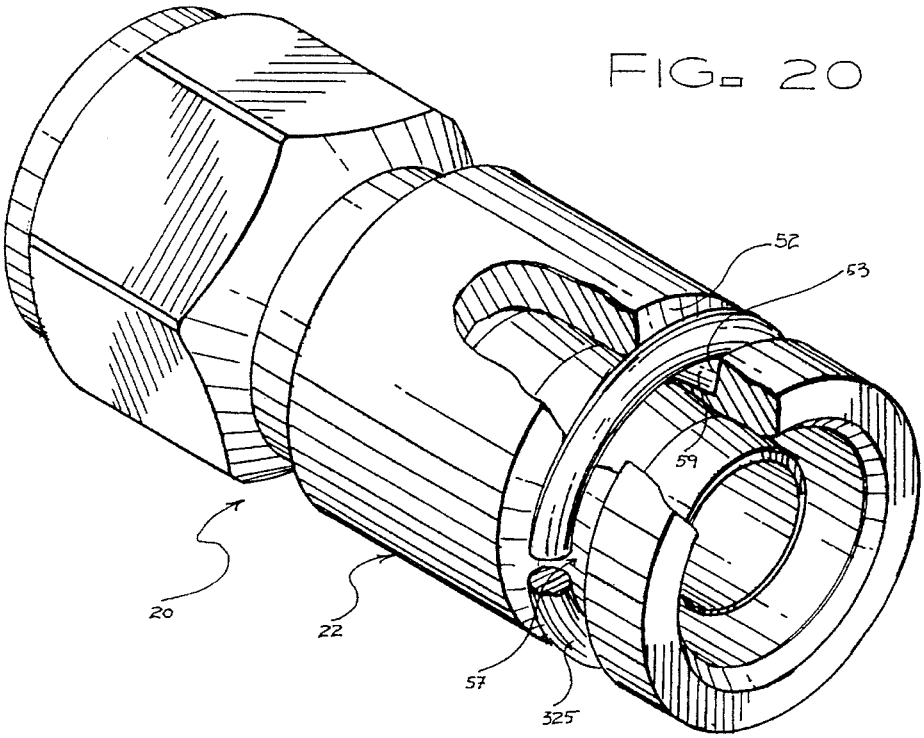
FIG. 20 is a partially sectioned perspective view of the connector of FIG. 1 with the addition of crimp limiting means.
Figure 21:
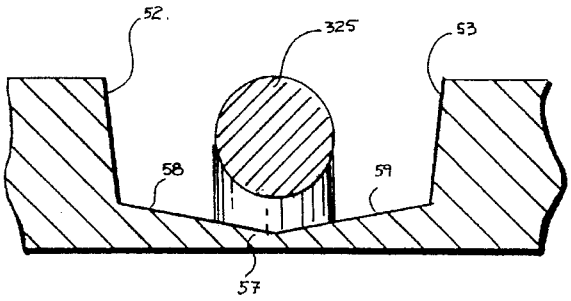
FIG. 21 is a partial sectional end view, illustrating limiting means prior to crimping.
Figure 22:
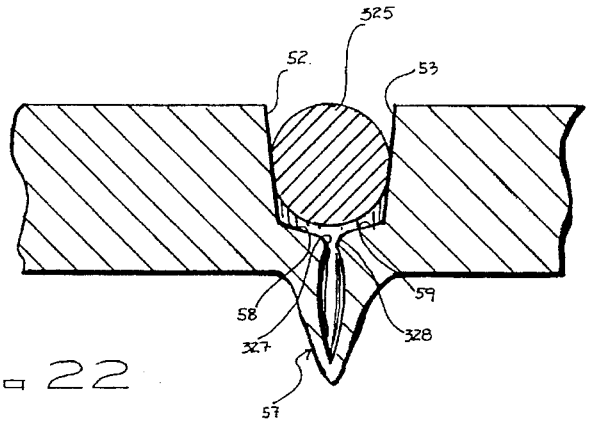
FIG. 22 is the partial sectional end view of FIG. 21 after crimping, wherein the crimp is limited by the limiting means.

Referring to FIGS. 20–22, a crimp limiting means is illustrated installed on connector 20 of FIGS. 1–4. In this embodiment, crimp limiting means consists of a toroidal ring 325 encircling body 22 within compression groove 50. Ring 325 is configured to receive sides 52 and 53 thereagainst when a longitudinal compressive force is applied to connector 20. The width of ring 325 is generally a fraction of the distance between sides 52 and 53, and determined by the desired depth of the deformation. When compression groove 50 is crimped, sloped surfaces 58 and 59 of bottom 57 are deformed at ridges 327 and 328 spaced from sides 52 and 53 respectively, allowing bottom 57 to project radially inward. It has been found that if the crimp is not limited, and ridges 327 and 328 contact one another, a non-uniform deformation results, forming an unsatisfactory mechanical coupling as well as providing a leak path for incoming moisture. Therefore, the appropriate width of ring 325 is a width which separates sides 52 and 53 sufficiently to prevents ridges 327 and 328 from coming into contact, as seen in FIG. 22.

Various changes and modifications to the embodiments herein chosen for purposes of illustration will readily occur to those skilled in the art. For example, while the coupling member is generally illustrated as a nut, it will be understood that any conventional coupling member may be employed, including connectors of the embodiments herein disclosed, for splicing coaxial cables. It is also noted that the improvements, specifically the securement members, can be practiced with conventional prior art connectors other than the specific type chosen for purposes of illustration. To the extent that such modifications and variations do not depart from the spirit of the invention, they are intended to be included within the scope of the following claims:

I claim:

1. A connector for securing a coaxial cable to a selected device, said connector comprising:

an outer member having a rearward end, a forward end, an outer surface and a bore defined by an inner surface, for receiving said coaxial cable; a coupling member attached to said forward end of said outer member for securing said coaxial cable to a selected device; and securement means carried by said outer member including a compression groove being deformable in a substantially uniformly radially inward direction, forming a continuous annular seal, mechanically and sealingly engaging said coaxial cable in response to a longitudinal compressive force.

2. A connector as claimed in claim 1 wherein said compression groove resides at a location nearer said rearward end than the forward end of said outer member.

3. A connector as claimed in claim 1, further including limit means for limiting deformation of said compression groove in said radially inward direction to a predetermined maximum.

4. A connector as claimed in claim 1 wherein said compression groove is formed in said outer surface of said outer member.

5. A connector as claimed in claim 4, wherein said compression groove includes a pair of opposed sides each intersecting the outer surface of said outer member to form a pair of spaced apart intersections, one of said intersections being urged in a direction toward the other of said intersections in response to said longitudinal compressive force.

6. A connector as claimed in claim 5, wherein said compression groove further includes a bottom extending between said sides and having a pair of opposed surfaces sloping generally radially inward to a central joint.

7. A connector as claimed in claim 5, wherein deformation in said radially inward direction is responsive to movement of one of said pair of intersections in the direction toward the other of said intersections.

8. A connector as claimed in claim 7, further including limit means for limiting said movement of one of said pair of intersections in the direction toward the other of said intersections.

9. A connector as claimed in claim 8, wherein said limit means includes a stop member for receiving the sides of said compression groove thereagainst.

10. A connector as claimed in claim 9, wherein said stop member includes a ring residing intermediate said sides and having a predetermined width.

11. A connector as claimed in claim 1, wherein said securement means further includes an inner member coupled with said outer member and extending coaxially therewith, said inner member being receivable within said coaxial cable for opposing said compression groove as said compression groove is deformed in said radially inward direction.

12. A connector as claimed in claim 11, wherein said inner member includes an outer surface having an expanded portion coupled to said inner surface of said outer member by a friction fit.

13. A connector as claimed in claim 12, further including a layer of ductile metal deposited on said inner surface of said outer member and on said expanded outer surface of said inner member coupling said inner member to said outer member by a cold flowing together of said respective layers.

14. A connector for securing a coaxial cable to a selected device, said connector comprising:

an outer member having a rearward end, a forward end, an outer surface and a bore defined by an inner surface, for receiving said coaxial cable;

a coupling member attached to said forward end of said outer member for securing said coaxial cable to a selected device; and securement means carried by said outer member for mechanically and sealingly engaging said coaxial cable in response to a longitudinal compressive force, said securement means including an intermediate member carried within said bore of said outer member and having an outer surface, an inner surface defining a bore for receiving said coaxial cable, an inner end and an outer end, and engagement means for constrictively, mechanically and sealingly engaging said coaxial cable in response to said longitudinal compressive force, thereby forming a continuous annular seal.

15. A connector as claimed in claim 14, wherein said intermediate member is frictionally coupled within said outer member.

16. A connector as claimed in claim 14, wherein said engagement means includes a compression groove formed in said outer surface of said intermediate member and being deformable in a substantially uniformly radially inward direction in response to said longitudinal compressive force.

17. A connector as claimed in claim 16, wherein said compression groove includes a pair of opposed sides each intersecting the outer surface of said outer member to form a pair of spaced apart intersections, one of said intersections being urged in a direction toward the other of said intersections in response to said longitudinal compressive force.

18. A connector as claimed in claim 17, wherein said compression groove further includes a bottom extending between said sides and having a pair of opposed surfaces sloping generally radially inward to a central joint.

19. A connector as claimed in claim 17, further including limit means for limiting said movement of one of said pair of intersections in the direction toward the other of said intersections.

20. A connector as claimed in claim 16, further including limit means for limiting deformation of said compression groove in said radially inward direction.

21. A connector as claimed in claim 20, wherein said limit means includes:

a shoulder proximate the forward end of said outer member for receiving an inner end of said intermediate member thereagainst;

a terminal portion of said intermediate member extending from the rearward end of said outer member and having an outwardly projecting flange; and said flange being normally spaced from said rearward end of said outer member a predetermined distance and being urged against said rearward end of said outer member in response to said longitudinal compressive force.

22. A connector as claimed in claim 14, wherein said outer member includes:

a primary portion attached to said coupling member;

a secondary portion carried by said primary portion;

a cavity defined within said primary and secondary portions for captively retaining said intermediate member; and said longitudinal compressive force being applied to said intermediate member in response to mutually inward movement of said primary and secondary portions along a common axis.

23. A connector as claimed in claim 22, further including sealing means for hermetically sealing one of said portions to the other of said portions in response to said mutually inward movement.

24. A connector as claimed in claim 22, further including sealing means carried within said cavity for hermetically sealing said cable within said outer member in response to said mutually inward movement.

25. A connector as claimed in claim 22, further including:

a first shoulder carried by said primary portion for receiving an end of said intermediate member thereagainst;

a second shoulder carried by said secondary portion for receiving another end of said intermediate member thereagainst; and camming means interacting between said bodies for moving one of said shoulders in a direction toward the other of said shoulders.

26. A connector as claimed in claim 25, wherein said portions are threadably coupled with said inward motion of said shoulders imparted by relative rotation of said portions.

27. A connector as claimed in claim 22, further including limit means for limiting the mutual inward movement of said portions along said common axis.

28. A connector as claimed in claim 27, wherein said limit means includes:

a first abutment shoulder carried by one of said portions;

a second abutment shoulder carried by the other of said portions and opposing said first abutment shoulder; and said first and second abutment shoulders normally being spaced apart a predetermined distance and urged into contact in response to said longitudinal compressive force.

* * * * *